US008585574B2

(12) United States Patent
Ten Eyck et al.

(10) Patent No.: US 8,585,574 B2
(45) Date of Patent: Nov. 19, 2013

(54) INFANT WARMER

(75) Inventors: Lawrence Guy Ten Eyck, Laurel, MD (US); Steven Mitchell Falk, Laurel, MD (US)

(73) Assignee: General Electric Company, Schenectady, NY (US)

( * ) Notice: Subject to any disclaimer, the term of this patent is extended or adjusted under 35 U.S.C. 154(b) by 297 days.

(21) Appl. No.: 12/890,053

(22) Filed: Sep. 24, 2010

(65) Prior Publication Data

US 2012/0078034 A1 Mar. 29, 2012

(51) Int. Cl.
*A61G 11/00* (2006.01)

(52) U.S. Cl.
USPC ..... 600/22; 119/304; 119/315; 119/311; 200/61; 236/2; 237/14; 237/3; 435/303.1; 435/809

(58) Field of Classification Search
USPC ..... 600/22; 119/304, 315, 311; 200/61; 236/2, 91; 237/14, 3; D24/163; 435/303.1, 809
See application file for complete search history.

(56) References Cited

U.S. PATENT DOCUMENTS

| | | | | |
|---|---|---|---|---|
| 5,186,710 | A * | 2/1993 | Koch et al. | 600/22 |
| 5,612,580 | A * | 3/1997 | Janonis et al. | 307/64 |
| 6,049,924 | A * | 4/2000 | Prows et al. | 5/427 |
| 6,213,935 | B1 * | 4/2001 | Mackin et al. | 600/22 |
| 2002/0161276 | A1 * | 10/2002 | Mountain | 600/22 |
| 2005/0070756 | A1 * | 3/2005 | Falk et al. | 600/22 |
| 2005/0183895 | A1 * | 8/2005 | Severns | 180/65.3 |
| 2010/0168502 | A1 | 7/2010 | Delaporte et al. | |

* cited by examiner

*Primary Examiner* — Christine Matthews
*Assistant Examiner* — Sunita Reddy

(57) ABSTRACT

An infant warmer includes an infant enclosure defining an infant compartment, and a heating system pneumatically coupled with the infant compartment. The heating system includes a heater configured to selectively transfer heat to the infant compartment, and a thermal storage device configured to store heat from the heater and to selectively transfer said stored heat to the infant compartment. The infant warmer also includes a controller operatively connected to the heating system. The controller is configured to regulate the transfer of heat from the thermal storage device such that a target temperature is maintained within the infant compartment.

17 Claims, 3 Drawing Sheets

INFANT WARMER

BACKGROUND OF THE INVENTION

The subject matter disclosed herein relates to an infant warmer with a thermal storage device.

Conventional infant incubators comprise a confined enclosure adapted to retain an infant in a controlled environment. A convective heating system generates heated air to regulate temperature within the enclosure. The heating system includes an electric heater configured to heat the air, and a fan configured to circulate the heated air.

One problem with conventional infant incubators is that the primary power source for the heating system can be unreliable, particularly in developing countries. Unreliable electrical power may compromise the regulated temperature within the controlled environment.

Another problem with conventional infant incubators is that the primary power source for the heating system can be inconsistent with periods of excess power (i.e., power spikes), and periods of inadequate power. Traditional infant incubators are incapable of converting a power spike to thermal energy without overheating the infant such that much of the excess electrical power is wasted. Wasting excess power to avoid overheating is a suboptimal use of energy that diminishes the efficiency of the system.

BRIEF DESCRIPTION OF THE INVENTION

The above-mentioned shortcomings, disadvantages and problems are addressed herein which will be understood by reading and understanding the following specification.

In an embodiment, an infant warmer includes an infant enclosure defining an infant compartment, and a heating system pneumatically coupled with the infant compartment. The heating system includes a heater configured to selectively transfer heat to the infant compartment, and a thermal storage device configured to store heat from the heater and to selectively transfer said stored heat to the infant compartment. The infant warmer also includes a controller operatively connected to the heating system. The controller is configured to regulate the transfer of heat from the thermal storage device such that a target temperature is maintained within the infant compartment.

In another embodiment, an infant warmer includes an infant enclosure defining an infant compartment, and a heating system pneumatically coupled with the infant compartment. The heating system includes a heater configured to selectively transfer heat to the infant compartment, and a thermal storage device configured to store heat from the heater and to selectively transfer said stored heat to the infant compartment. The heating system also includes a fan configured to facilitate the transfer of heat from the thermal storage device to the infant compartment, and an insulated housing at least partially enclosing the thermal storage device, said insulated housing comprising an insulated door. The infant warmer also includes a controller operatively connected to the heating system. The controller is configured to regulate the speed of the fan and/or the position of the insulated door to control the transfer of heat from the thermal storage device such that a target temperature is maintained within the infant compartment.

Various other features, objects, and advantages of the invention will be made apparent to those skilled in the art from the accompanying drawings and detailed description thereof.

DETAILED DESCRIPTION OF THE INVENTION

In the following detailed description, reference is made to the accompanying drawings that form a part hereof, and in which is shown by way of illustration specific embodiments that may be practiced. These embodiments are described in sufficient detail to enable those skilled in the art to practice the embodiments, and it is to be understood that other embodiments may be utilized and that logical, mechanical, electrical and other changes may be made without departing from the scope of the embodiments. The following detailed description is, therefore, not to be taken as limiting the scope of the invention.

Figure 1:
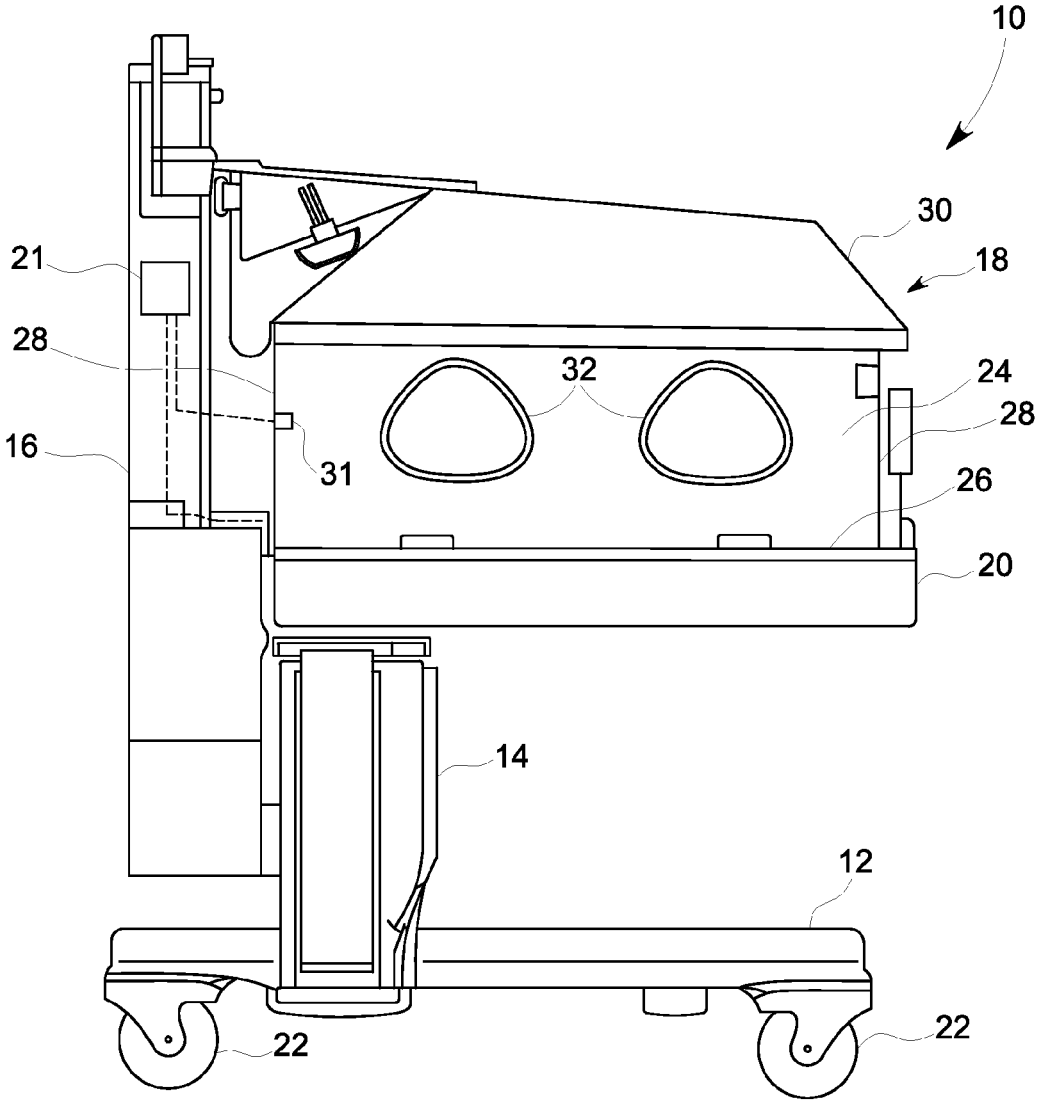
FIG. 1 is a side view of an infant warmer in accordance with an embodiment.

Referring to FIG. 1, a side view of an infant warmer 10 is shown in accordance with an embodiment. The infant warmer 10 may include a base 12, a vertical member 14, a vertical frame 16, an infant enclosure 18, a heating system 20, and a controller 21. The base 12 may include one or more wheels 22 to facilitate translation of the warming apparatus 10. The vertical member 14 is secured to the base 12, and the vertical frame 16 is secured to the vertical member 14.

The infant enclosure 18 defines an infant compartment 24. The infant compartment 24 provides a controlled environment where heat and humidity can be regulated to aid in the development and well being of the infant. The infant enclosure 18 may be mounted to the vertical member 14 and/or the vertical frame 16. The infant enclosure 18 includes an infant platform 26, a plurality of walls 28, a canopy 30, and a sensor 31.

The infant platform 26 supports an infant (not shown) disposed within the infant compartment 24. The walls 28 extend upwardly from the periphery of the infant platform 26. The walls 28 generally comprise a transparent plastic material. The walls 28 may define hand holes 32 to enable the caregiver to reach an infant within the infant compartment 24. The canopy 30 overlies the infant platform 26 and may comprise a transparent material that covers the upper peripheral edges of the walls 28. The sensor 31 may be connected to the controller 21 and disposed within the infant compartment 24. According to one embodiment, the sensor 31 comprises a thermal sensor adapted to measure the temperature within the infant compartment 24 and to transfer measured temperature data to the controller 21.

The heating system 20 may be disposed immediately below the infant platform 26 as shown in FIG. 1. The heating system 20 is pneumatically coupled with the infant compartment 24 such that thermal energy is transferable therebetween. The controller 21 may be operatively connected to the heating system 20 in order to regulate heating system operation and thereby maintain a predetermined target temperature within the infant compartment 24.

Figure 2:
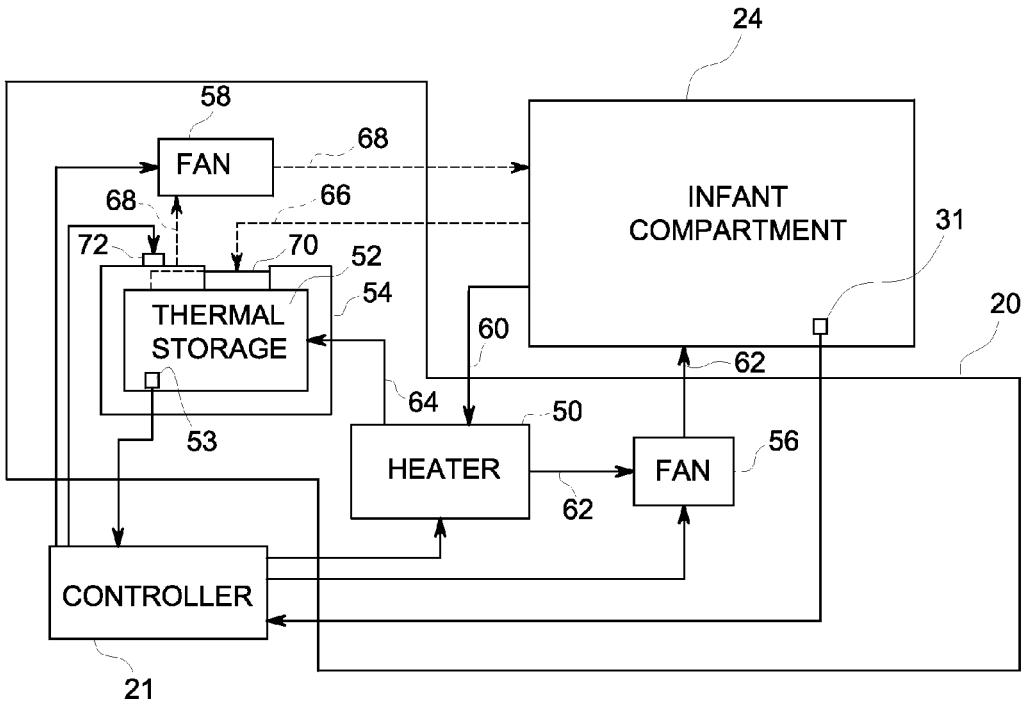
FIG. 2 is a schematic representation of a heating system in a thermal storage mode.
Figure 3:
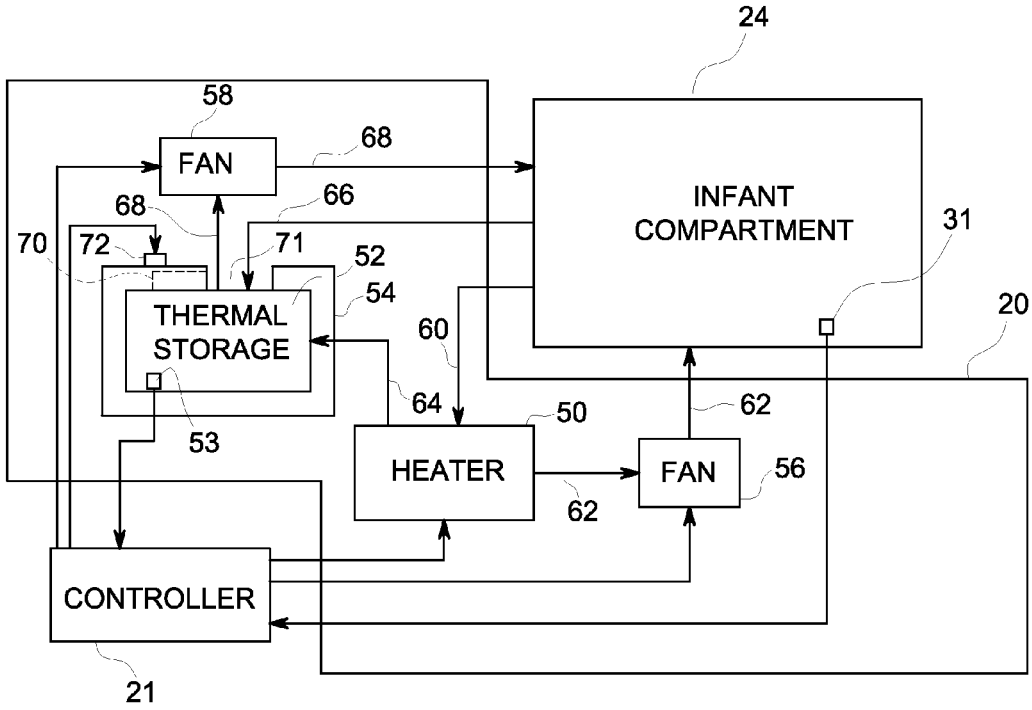
FIG. 3 is a schematic representation of a heating system in a thermal release mode.

Referring now to FIGS. 2-3, the heating system 20 is shown in accordance with an embodiment. The heating system 20 includes a heater 50, a thermal storage device 52, an insulated housing 54, a plurality of fans 56-58, and plurality of channels or passageways 60-68.

Referring to FIG. 2, the heating system 20 is schematically depicted in a thermal storage mode in which the heater 50 is implemented to heat the infant compartment 24 and/or transfer heat to the thermal storage device 52. Advantageously, the storage of thermal energy in the manner described can retain energy from power spikes that would otherwise be lost in conventional systems thereby increasing the efficiency of the heating system 20. More precisely, when a conventional heating system encounters a power surge or spike, the excess power cannot effectively be converted to heat without overheating the infant. In one embodiment of the heating system 20, the controller 21 can divert excess power from a surge or spike to the thermal storage device 52 such that the excess power is stored and may later be implemented to heat the infant compartment 24 thereby increasing efficiency. This advantage is particularly significant in developing countries in which the power supply is frequently inconsistent.

The heater 50 is pneumatically coupled with the infant compartment 24 via channels 60 and 62. The channels 60 and 62 are respectively configured to transfer cooler air from the infant compartment 24 to the heater 50, and warmer air from the heater 50 to the infant compartment 24. A fan 56 is pneumatically coupled with the channel 62 to facilitate the transfer of heated air from the heater 50 to the infant compartment 24. According to one embodiment, the heater 50 comprises an electric heater that can be plugged into and powered by an electrical outlet. It should, however, be appreciated that the heater 50 may alternatively be powered by other known power sources such as, for example, solar cells, a generator, a battery, a windmill, etc.

The heater 50 is also pneumatically coupled with the thermal storage device 52 via channel 64 such that thermal energy from the heater 50 can be transferred to and stored by the thermal storage device 52. The thermal storage device 52 may comprise any known material suited for retaining or storing thermal energy. A non-limiting list of thermal storage device materials may include highly dense solids such as stone, masonry or metallic materials; liquids; and/or phase change materials. The thermal storage device 52 may include a sensor 53 connected to the controller 21. According to one embodiment, the sensor 53 comprises a thermal sensor adapted to measure thermal storage device temperature and to transfer measured temperature data to the controller 21.

The insulated housing 54 is adapted to thermally insulate the thermal storage device 52. The insulated housing 54 may comprise an insulated door 70 and an actuator 72. The insulated door 70 may be retractable within the housing 54 by a selectable degree from a fully closed position shown in FIG. 2 to a fully open position shown in FIG. 3. The actuator 72 may be configured to retract and extend the insulated door 62. The actuator 72 may comprise any known actuator device such as, for example, a servomotor. The actuator 72 may be operatively connected to and regulated by the controller 21. In the thermal storage mode depicted in FIG. 2, the insulated door 70 is preferably fully closed such that the thermal storage device 52 is completely surrounded by insulating material thereby limiting thermal loss. A non-limiting list of material compositions for the insulated housing 54 and/or the insulated door 70 includes fiberglass insulation and foam insulation.

In the thermal storage mode depicted in FIG. 2, the controller 21 may be operatively connected to the heater 50, the fan 56, and the sensor 31. The controller 21 can regulate heater 50 operation based in part on feedback from the sensor 31. As an example, the controller 21 may operate the heater 50 to transfer heat to the infant compartment 24 until feedback from a sensor 31 within the infant compartment 24 indicates a target temperature has been reached. Thereafter, the controller 21 can operate the heater 50 in a manner adapted to maintain the target temperature within the infant compartment 24 while diverting any excess heat from the heater 50 to the thermal storage device 52.

Referring to FIG. 3, the heating system 20 is schematically depicted in a thermal release mode in which the infant compartment 24 can receive thermal energy from the heater 50 and/or the thermal storage device 52. The thermal release mode enables the infant warmer 10 to remain operational during periods in which the primary power supply is unavailable. This is particularly advantageous in developing countries in which power loss is relatively common.

While the insulated door 70 is depicted as being fully open (i.e., fully retracted within the insulated housing 54), it should be appreciated that the insulated door 70 can be selectively retracted to any position between fully closed (shown in FIG. 2) and fully open (shown in FIG. 3). At any open position, the insulated door 70 defines an aperture 71 in the insulated housing 54 through which heat can be transferred. The size of the aperture 71 and a corresponding thermal transfer rate are directly proportional to the position of the insulated door 70.

In the thermal release mode, the thermal storage device 52 is pneumatically coupled with the infant compartment 24 via channels 66 and 68. The channels 66 and 68 are respectively configured to transfer cooler air from the infant compartment 24 to the thermal storage device 52, and warmer air from the thermal storage device 52 to the infant compartment 24. The fan 58 is pneumatically coupled with the channel 68 to facilitate the transfer of heated air from the thermal storage device 52 to the infant compartment 24.

The controller 21 may be implemented to regulate the rate of thermal transfer from the thermal storage device 52 to the infant compartment 24 such that a target temperature is maintained. The thermal transfer rate may be regulated by adjusting fan 58 speed and/or insulated door 70 position. The following will provide several non-limiting examples.

According to one embodiment, the controller 21 can regulate thermal transfer rate by adjusting fan 58 speed to maintain a target temperature in the infant compartment 24. As an example, the controller 21 can increase fan 58 speed to increase the thermal transfer rate if the sensor 31 indicates that the measured temperature within the infant compartment 24 is significantly below a target temperature. The controller 21 can decrease fan 58 speed to reduce the thermal transfer rate if the sensor 31 indicates that the measured temperature within the infant compartment 24 is approaching the target temperature.

According to another embodiment, the controller 21 can regulate thermal transfer rate by adjusting the position of the insulated door 70 to maintain a target temperature in the infant compartment 24. As an example, the controller 21 can open the insulated door 70 fully (as shown in FIG. 3) to transfer thermal energy at a higher rate if the sensor 31 indicates that the measured temperature within the infant compartment 24 is significantly below the target temperature. The controller 21 can partially open the insulated door 70 to transfer thermal energy at an intermediate rate if the sensor 31 indicates that the measured temperature within the infant compartment 24 is slightly below the target temperature. The controller 21 can completely close the insulated door 70 (as shown in FIG. 2) if the sensor 31 indicates that the measured temperature within the infant compartment 24 is at the target temperature.

The controller 21 may be configured to estimate a thermal transfer rate associated with a given fan 58 speed and/or insulated door 70 position in order to more accurately maintain a target temperature. This thermal transfer rate estimation may be based on measured data, relevant material properties, and/or calculations. As a non-limiting example, the controller 21 may estimate the thermal transfer rate from the thermal storage device 52 based on one or more of the following: the measured temperature of the thermal storage device 52 from sensor 53; material characteristics of the thermal storage device 52 such as heat capacity and thermal conductivity; calculations derived from thermodynamics and/or heat transfer (e.g., the heat equation); calculations based on the exposed surface area of the thermal storage device 52 at different insulated door 70 positions.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal language of the claims.

We claim:

1. An infant warmer comprising:

an infant enclosure defining an infant compartment;

a heating system pneumatically coupled with the infant compartment via a channel, said heating system comprising:

a heater that selectively transfers heat to the infant compartment via the channel; and a thermal storage device that stores heat from the heater and selectively transfers said stored heat to the infant compartment via the channel; and an insulated housing at least partially enclosing the thermal storage device, said insulated housing comprising an insulated door; and a controller operatively connected to the heating system, said controller configured to control the position of the insulated door and regulate the transfer of heat from the thermal storage device to the infant compartment such that a target temperature is maintained within the infant compartment.

2. The infant warmer of claim 1, wherein said heating system further comprises a fan operatively disposed between the thermal storage device and the infant enclosure, said fan configured to facilitate the transfer of heat from the thermal storage device to the infant compartment.

3. The infant warmer of claim 2, wherein said controller is configured to control the speed of the fan to regulate the transfer of heat from the thermal storage device.

4. The infant warmer of claim 1, wherein the insulated housing further comprises an actuator configured to retract the insulated door within the insulated housing when the insulated door is in a fully open position.

5. The infant warmer of claim 1, wherein the insulated housing further comprises an actuator configured to close the insulated door such that the thermal storage device is surrounded by the insulated housing.

6. The infant warmer of claim 1, wherein the infant enclosure comprises a first thermal sensor adapted to measure the temperature within the infant compartment.

7. The infant warmer of claim 6, wherein the controller is configured to regulate the transfer of heat from the thermal storage device at least partially based on feedback from the first thermal sensor.

8. The infant warmer of claim 1, wherein the heating system further comprises a second thermal sensor adapted to measure the temperature of the thermal storage device.

9. The infant warmer of claim 8, wherein the controller is configured to regulate the transfer of heat from the thermal storage device at least partially based on feedback from the second thermal sensor.

10. The infant warmer of claim 1, wherein the thermal storage device is selected from at least one of a highly dense solid, a liquid, and a phase change material.

11. The infant warmer of claim 10, wherein the thermal storage device comprises stone, masonry or metallic materials.

12. An infant warmer comprising:

an infant enclosure defining an infant compartment;

a heating system pneumatically coupled with the infant compartment, said heating system comprising:

a heater configured to selectively transfer heat to the infant compartment;

a thermal storage device that stores heat from the heater and selectively transfers said stored heat to the infant compartment;

a fan that facilitates the transfer of heat from the thermal storage device to the infant compartment; and an insulated housing at least partially enclosing the thermal storage device, said insulated housing comprising an insulated door; and a controller operatively connected to the heating system, said controller configured to control the speed of the fan and a position of the insulated door and regulate the transfer of heat from the thermal storage device to the infant compartment such that a target temperature is maintained within the infant compartment.

13. The infant warmer of claim 12, wherein the infant enclosure comprises a first thermal sensor adapted to measure the temperature within the infant compartment.

14. The infant warmer of claim 13, wherein the controller is configured to regulate the speed of the fan and/or the position of the insulated door at least partially based on feedback from the first thermal sensor.

15. The infant warmer of claim 12, wherein the heating system further comprises a second thermal sensor adapted to measure the temperature of the thermal storage device.

16. The infant warmer of claim 15, wherein the controller is configured to regulate the speed of the fan and/or the position of the insulated door at least partially based on feedback from the second thermal sensor.

17. The infant warmer of claim 12, wherein the controller is configured to regulate the speed of the fan and/or the position of the insulated door at least partially based on a material characteristic of the thermal storage device.

* * * * *